US006296678B1

(12) United States Patent
Merzbacher et al.

(10) Patent No.: US 6,296,678 B1
(45) Date of Patent: Oct. 2, 2001

(54) LONG DURATION INFRARED-EMITTING MATERIAL

(75) Inventors: Celia Merzbacher, Alexandria, VA (US); Ken Limparis, Fort Washington, MD (US); Robert Bernstein, Glastonbury, CT (US); Debra Rolison, Arlington, VA (US); Zachary J. Homrighaus, Cortland, NY (US); Alan D. Berry, Springfield, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/384,428

(22) Filed: Aug. 27, 1999

(51) Int. Cl.[7] ..... C10L 11/00; B05D 3/02

(52) U.S. Cl. ..... 44/542; 44/543; 149/30; 149/37; 149/44; 149/108.2; 149/108.6; 149/109.6; 149/114; 149/115; 427/226; 427/229; 427/244; 427/248.1; 427/252; 427/255; 428/304.4; 428/304.5

(58) Field of Search ..... 44/542, 543; 149/44, 149/30, 37, 114, 115, 108.6, 109.6, 108.2; 427/226, 229, 244, 248.1, 252, 255; 428/304.4, 304.5

(56) References Cited

U.S. PATENT DOCUMENTS 3,385,681 * 5/1968 Mennen ..... 44/543
4,997,804 * 3/1991 Pekala ..... 502/418
5,056,435 * 10/1991 Jones et al. ..... 149/41
5,086,085 * 2/1992 Pekala ..... 521/187
5,855,953 * 1/1999 Cao et al. ..... 427/248.1
5,879,744 * 3/1999 Cao et al. ..... 427/226

FOREIGN PATENT DOCUMENTS

8096696 A * 8/1983 (JP) .

* cited by examiner

*Primary Examiner*—Margaret Medley
(74) *Attorney, Agent, or Firm*—John J. Karasek; George A. Kap

(57) ABSTRACT

This invention pertains to an article that emits infrared radiation for a period of about 15 minutes or more, depending on the size and shape, and to a process for preparing the article. The article includes, in a preferred embodiment, a combustible aerogel or other nanocellular substrate with iron metal impregnant formed by thermal decomposition of iron pentacarbonyl deposited on and in the substrate in an amount of at least about 5% or at least about 20% of the weight of the substrate, depending on the substrate. The impregnant reacts exothermically on contact with air or an oxygen-containing gas and imparts sufficient energy to the substrate to cause it to burn for about 30 seconds to about 30 minutes depending on size and shape, thereby emitting infrared radiation. The process pertains to deposition of the impregnant on and in the substrate by flowing a carrier gas saturated with the impregnant precursor over and through the substrate. Liquid impregnant precursors can be transported to the substrate by bubbling a carrier gas through the precursor. Solid impregnant precursors can be thermally volatilized and similarly deposited on and in the substrate. Soluble impregnants, or their precursors, can be deposited on the internal and external surfaces of the substrate by diffusing the precursor solution into the pores and distilling off the solvent under inert atmosphere, leaving the pyrophoric impregnant in and on the substrate surfaces.

14 Claims, 1 Drawing Sheet

LONG DURATION INFRARED-EMITTING MATERIAL

BACKGROUND

1. Field of Invention

This invention pertains to a combustible aerogel or other nanocellular substrate having an impregnant on its internal and external surfaces that reacts spontaneously upon exposure to air to produce infrared and/or visible radiation and a process for its preparation.

2. Description of Related Art

Solid materials that spontaneously react exothermically with air, thereby emitting significant infrared or visible radiation fall primarily into two categories The first is fine powders of various elements, mostly metals, including iron, nickel, aluminum, magnesium, calcium, lithium, sodium, potassium, phosphorous, zirconium and titanium, and their alloys. The second category is activated metal foils, including iron, nickel and cobalt.

A number of techniques exist to produce metal powders including milling, atomization, reduction of metal oxides or solutions of metal salts, and decomposition of metal carbonyls. Some metals, such as iron, can be prepared as extremely fine powders by segregating Fe(II) in reverse micelle solutions and reducing to metal by exposure to hydrazine. Raney metal powders, such as iron or nickel, are synthesized by leaching Al from an alloy of Ni or Fe and Al.

For some applications, it is desirable to have a bulk material rather than powders. While powders can be mixed with binders or imbedded in material such as carbon cloth to form a bulk, an alternative is to activate the surface of bulk metals. Metals, such as iron, nickel or cobalt, can be activated by a diffusion and leaching process yielding a highly porous surface layer, thereby increasing the area of metal surface available for oxidation and hence the amount of heat generated. Typically, activated metals are prepared in a two-dimensional foil to minimize the volume of non-reactive material. The duration of IR emission can be tailored from about 3 seconds to about 30 seconds by adjusting the size and form of the activated metal foil.

This patent relates to a new type of solid material that spontaneously emits infrared and/or visible radiation upon exposure to air. These materials comprise a highly porous, combustible substrate combined with an impregnant on the internal and external surfaces that generates sufficient heat upon exposure to air to initiate the combustion of the substrate. These materials have several unique properties. They are extremely lightweight and are distinctly superior to existing materials in terms of the duration of emission, which can be very long (about 30 minutes) or very short (about 30 seconds), depending on the size of the substrate. They are frangible, allowing them to be stored as large monoliths, yet readily broken into smaller pieces during deployment. In a preferred embodiment, the substrate is a combustible aerogel or other porous nanocellular material.

Aerogels are a class of materials with extremely low density, high porosity and high surface area. Their physical properties result from their structure, which consists of nanometer-scale solid particles that are connected to form a three-dimensional, mesoporous network Aerogels are generally prepared by synthesizing a sol-gel with a large volume fraction of liquid and then removing the solvent from the pores supercritically in order to avoid large capillary forces and shrinkage during drying. A range of compositions can be prepared as aerogels, including silica, alumina, zirconia, titania and several organic compounds, including carbon, resorcinol/formaldehyde and melamine/formaldehyde.

A new proprietary process has recently been developed for preparing organic nanocellular materials that have physical properties similar to aerogels. This proprietary process uses modified parameters during the sol-gel reaction, which strengthens the gel structure such that it can be dried under ambient conditions without significant collapse or shrinkage of the pores. The resulting material has physical properties that are similar to the supercritically dried aerogel form.

Combustible porous, nanoscale material can also be prepared by adding a combustible powder during the synthesis of a non-combustible aerogel. In order to avoid coating the powder with the non-combustible phase and thereby inhibiting the burning of the combustible component, the powder is commingled with the sol shortly before gelation occurs either by briefly mixing or pouring the sol over the dry powder. After supercritical drying, the composite has the physical properties of the single phase, noncombustible aerogel and the combustible phase is accessible via the interconnected porosity.

OBJECTS AND BRIEF SUMMARY OF INVENTION

It is an object of this invention to provide a frangible, solid material that emits infrared and/or visible radiation spontaneously upon exposure to air.

It is another object of this invention to provide long duration of infrared or visible emission.

It is another object of this invention to use, as the substrate, a combustible, porous, high surface area material.

It is another object of this invention to use an impregnant that reacts exothermically in an oxygen-containing environment.

It is another object of this invention to have an impregnant on and in the substrate that provides sufficient heat thereto, upon exposure to an oxygen-containing gas, to enable the substrate to ignite.

These and other objects of this invention can be attained by a composite material that is a combustible, porous, nanostructured substrate impregnated with iron metal formed by thermal decomposition of iron pentacarbonyl.

DETAILED DESCRIPTION OF INVENTION

Figure 1:
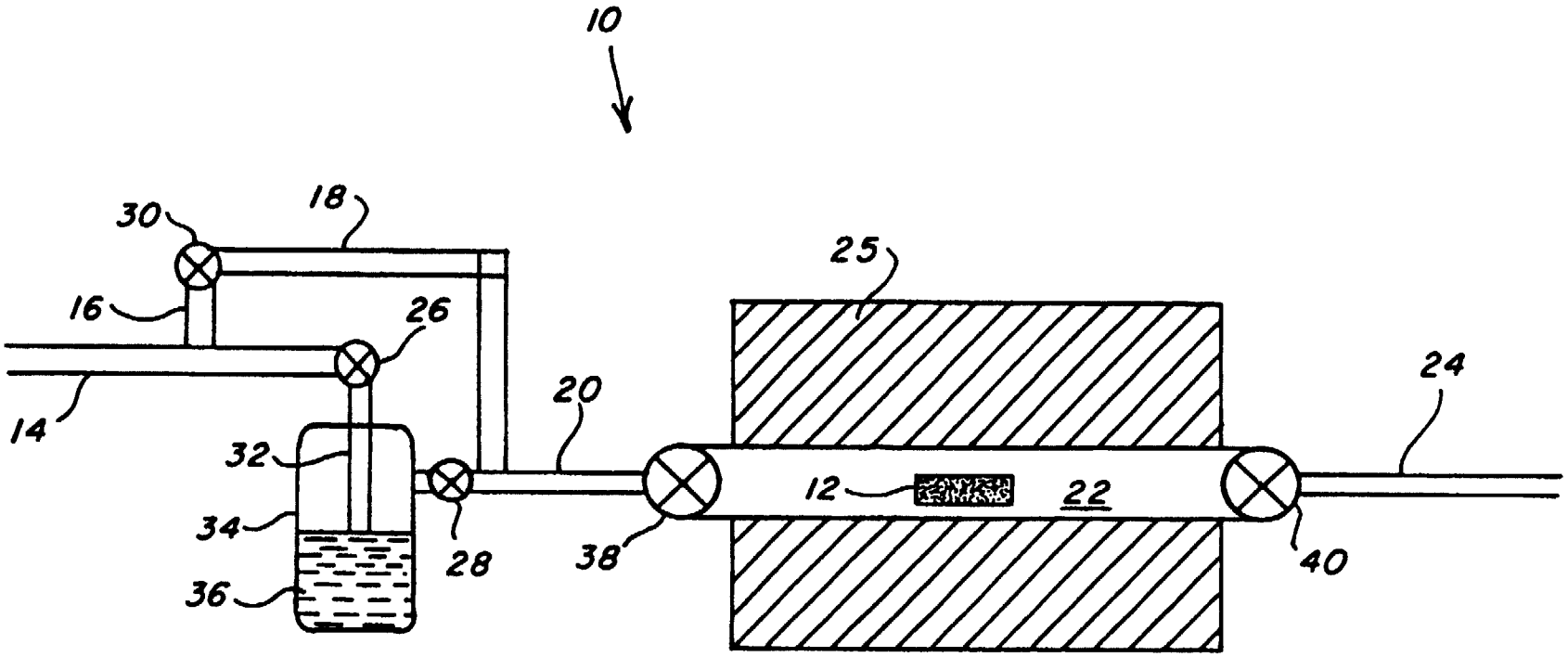
FIG. 1 is a schematic illustration of an apparatus that can be used to coat the exterior and the internal surfaces of a porous substrate.

This invention pertains to material that emits infrared and/or visible radiation comprised of a combustible substrate and an impregnant that spontaneously reacts exothermically upon exposure to air. The composite material is pyrophoric, that is it spontaneously ignites upon exposure to air or an oxygen-containing atmosphere, and burns for a period ranging from about 30 seconds to about 30 minutes, depending on the size and shape of the sample. The treated material can be used in temporary or emergency flares or markers, as alternative targets for infrared tracking devices, and in other ways.

The substrate can be any material that can be ignited by the impregnant The substrate suitable for purposes herein is a combustible material with high porosity, permeability and surface area. Such substrates have continuous porosity and ultrafine cell size less than about 0.5 micron and its density is less than about 0.3 g/cm$^3$, although red phosphorus/silica aerogel has a higher density of about 1 g/cm$^3$. Preferred substrates are produced from formaldehyde and a polyhydroxybenzene such as catechol, resorcinol, phloroglucinol, hydroquinone and mixtures thereof Preferred substrates also include carbon aerogel or nanocellular material and red phosphorus/silica composite aerogels. The most preferred formaldehyde/polyhydroxybenzene substrate for purposes herein is resorcinol/formaldehyde aerogel.

The substrate can be prepared by mixing a phenolic substance, such as a polyhydroxybenzene, preferably a dihydroxy- or a trihydroxybenzene, or mixtures thereof, with formaldehyde in aqueous solution, in the presence of a catalyst to form a polymeric gel. Sodium carbonate is a suitable base catalyst although other catalysts can be used. The reactants can be heated to a temperature of 60–100° C. to form the gel, which can then be placed in dilute acid to increase the crosslinking density of the gel. The pore-filling liquid can then be exchanged with an organic solvent suitable for supercritical drying after which it is supercritically dried to form the aerogel.

Another preferred substrate can be prepared by pyrolysis of a dried polyhydroxybenzene/formaldehyde aerogel or nanocellular material to form a pure carbon material with similarly high porosity and surface area The pyrolysis can be achieved by heating the organic material to about 1015° C. holding for about one half hour and then cooling, at rates that are slow enough to avoid cracking.

Another preferred substrate can be prepared by incorporating a combustible powder, such as red phosphorous, in an inert aerogel, such as silica, such that the combustible powder is accessible via the interconnected aerogel porosity. A silica sol can be prepared by the base or acid catalyzed hydration and condensation of a silicon alkoxide, preferably tetramethoxysilane or tetraethoxysilane, or mixtures thereof. Ammonium hydroxide is a suitable base catalyst, although other catalysts can be used. The amount of catalyst is selected to achieve a gelation time that is slow enough to allow the sol to be mixed with the powder, but fast enough to prevent the powder from becoming completely coated. Preferably, gelation occurs between one and ten minutes after mixing the sol and the powder. The sol can be poured over the powder in a mold, allowed to gel and then age, to increase its strength, and then removed from the mold. The composite gel can then be washed and supercritically dried in a manner similar to any single-phase aerogel.

The impregnant can be any material that can be deposited on and in the substrate and that provides sufficient energy to the substrate, upon exposure to air or an oxygen-containing atmosphere, to cause it to combust. Suitable impregnants include iron, nickel, aluminum, magnesium, calcium, lithium, sodium, potassium, phosphorous, zirconium and titanium; and mixtures thereof The preferred impregnant is iron metal derived from the thermal decomposition of iron pentacarbonyl, $Fe(CO)_5$.

Although the impregnant can be deposited on the substrate, or on and in the substrate, in any suitable manner, FIG. 1 illustrates a flow-through apparatus 10 that can be used when the impregnant precursor is a liquid. As illustrated in FIG. 1, a carrier gas can be directed either through tubes 14, 16, 18, and 20 to the reaction tube 22 and out through tube 24, or through the liquid impregnant precursor 36 held in the glass flask 34, by way of tubes 14, 32, 20, 22, and 24. The flow of the carrier gas is controlled by valves 26, 28, and 30. The substrate 12, which is disposed in reaction tube 22, is constrained in size and shape only by the size of tube 22. Reaction tube 22 was glass, circular in cross-section, 35-cm long and 1.2-cm o.d., but the exact size was not critical. The reaction tube can be sealed by closing valves 38 and 40, however these valves are open throughout the impregnation. With valves 26 and 28 closed and the carrier gas flowing through tubes 14, 16, 18 and 20, the reaction tube 22, which is held in tube furnace 25, is heated to remove surface-adsorbed water and other volatile compounds from the substrate. Resorcinol-formaldehyde aerogel can have over 10 wt. % adsorbed volatiles that are removed by heating to 250° C.

After water and other volatile compounds are removed from the substrate and the substrate is cooled to the deposition temperature, valve 30 is closed and valves 26 and 28 are opened so that the carrier gas is flowed through tubes 14, 32, 20, 22, and 24. As shown in FIG. 1, the outlet of tube 32 is below the surface of the liquid impregnant precursor 36. By introducing the carrier gas below the liquid surface, the gas that exits flask 34 via valve 28 is saturated with the volatilized impregnant precursor. As the vapor that is saturated in impregnant precursor is carried through tube 22 and is heated, it decomposes, all or in part, to the pyrophoric impregnant. In order to assure a low partial pressure of oxygen a small amount, under 10% by volume, of a reducing gas can be mixed with the inert gas. At least some of the pyrophoric impregnant is deposited on and within the substrate. The impregnant should also be deposited on the interior of the substrate so that, on disintegration of the substrate into many fragments every, or nearly every, fragment will have sufficient impregnant to provide energy to the substrate fragment to cause it to combust.

For a 0.5-cm$^3$ substrate, it takes about 6 hours (including heating and cooling) to remove water and any other volatiles and to deposit sufficient impregnant on and in the substrate, flowing 50–100 ccm of carrier gas through the apparatus shown in FIG. 1 throughout the process. If the surface area of substrate to be coated is increased, either by increasing the sample size or by placing more than one substrate within tube 22, it will take longer to deposit on and in the substrate samples a sufficient amount of the impregnant for the impregnated substrates to combust upon exposure to an oxygen-containing atmosphere. Furthermore, if there is more than one substrate in reaction tube 22, the substrates which are upstream in the carrier gas, i.e., those which are first contacted by the vapor saturated with the impregnant precursor, will have more of the impregnant on their exterior and internal surfaces than the substrate samples downstream When the impregnation is complete, valves 26 and 28 are closed, valve 30 is opened so that carrier gas without iron pentacarbonyl flows over the impregnated material as it is cooled to room temperature. Once cooled, valves 38 and 40 are closed and the material is removed from the reaction tube in an inert atmosphere and stored in an airtight container also under inert atmosphere.

The apparatus shown in FIG. 1 is suitable for impregnation by any liquid impregnant precursor. If a solid impregnant precursor that can be volatilized by heating is to be used, the apparatus can be modified so that the impregnant precursor is held in a separate reaction tube with temperature control. After the substrate is heated to remove adsorbed volatile compounds, the precursor can be volatilized by heating, and the carrier gas can transport the impregnant precursor to the substrate, which is held in a separate reaction tube at the deposition temperature. The temperature seen by the carrier gas between the precursor and the sample must be sufficient to prevent condensation, but insufficient to cause decomposition. A solid volatile impregnant precursor can also be deposited on the internal and external surfaces of a porous substrate by heating the substrate and precursor together in a sealed vessel to temperatures sufficient to volatilize the impregnant precursor. The impregnant will then diffuse into the substrate and deposit on the surfaces upon cooling.

Spontaneously reactive materials, or their precursors, that are soluble can be impregnated into a porous substrate by allowing the precursor solution to fill the pores and then removing the solvent by distillation. This process can be used to deposit pyrophoric phosphorus, which is soluble in carbon disulfide, in and on a porous substrate.

Upon exposure to air or oxygen-containing gas, the impregnant exothermically reacts, producing sufficient heat to ignite the combustible substrate. The material will continue to burn, emitting blackbody radiation correlating to the combustion temperature of the substrate along with emission associated with any concurrent reaction, until the entire substrate is consumed.

The duration of inftared emission is therefore dependent on the minimum dimension of the substrate; a larger substrate will have a longer burn duration. A resorcinol-formaldehyde aerogel substrate that is 6 mm×6 mm×10 mm bums for about 5 minutes.

Weight of the impregnant on and in the substrate should be at least about 5% or about 20% of the weight of the substrate, depending on the substrate. In a preferred embodiment, the weight of impregnant should be 50%–150% of the weight of the substrate. Amounts of impregnant below about 5% or 20% of the weight of the substrate are typically insufficient to impart enough energy to ignite the substrate. Amounts in excess of about 150% of the weight of the substrate are simply a waste of impregnant.

The thermal emitters described herein have at least three features that distinguish them from currently available materials: much longer burn duration, greater intensity at longer IR wavelengths relative to shorter IR wavelengths, and greater frangibility.

Having described the invention, the following examples are given as a particular embodiment thereof and to demonstrate the practice and advantages thereof It is understood that the examples are given by way of illustration and are not intended to limit the specification or the claims in any manner.

EXAMPLE 1

This example demonstrates impregnation of a resorcinol-formaldehyde aerogel substrate sample measuring 10 mm×6 mm×6 mm with decomposition products of iron pentacarbonyl impregnant using the apparatus illustrated in FIG. 1. The sample was prepared with a resorcinol catalyst molar ratio of 200:1. The catalyst was sodium carbonate.

The gas mixure that was flowed through the apparatus of FIG. 1 had the composition of 65 ccm of argon and 3.2 ccm of hydrogen. The substrate sample in tube 22 was heated at a rate of 5° C./min to 250° C. to remove adsorbed water and any other volatile compounds on the sample, while $Ar/H_2$ gas was flowed through tubes 14, 16, 18, 20, 22 and 24 with valves 26, 28 shut and valve 30 open The sample was held at 250° C. for 30 minutes and then cooled at 5° C./min to 100° C. In order to deposit the impregnant, valve 30 was closed and valves 26 and 28 were opened to allow the gas to flow through tubes 14, 32, 20, 22 and 24. After bubbling through iron pentacarbonyl, a brown liquid held in flask 34, the carrier gas saturated with iron pentacarbonyl entered the reaction tube 22. At the deposition temperature of 100° C. and in an inert atmosphere, iron pentacarbonyl decomposes, at least in part, to iron metal ($Fe^0$) which is pyrophoric when finely divided. The iron metal formed by thermal decomposition of iron pentacarbonyl deposits on and in the aerogel substrate 12. Deposition time was 180 minutes and the weight increased by about 100%. The weight before deposition was 0.077 g and after deposition was 0.1215 g. The unimpregnated sample had about 2 wt. % surface moisture, which was removed before deposition of the impregnant.

EXAMPLE 2

The same deposition procedure as described in Example 1 was used to deposit iron from iron pentacarbonyl on a 0.17-$cm^3$ piece of commercially obtained nanocellular carbon which was nonsupercritically dried, with the following exception. The deposition time was 300 minutes and the weight increased by about 20%. The weight before deposition was 0.052 g and after deposition was 0.0631 g. Any adsorbed surface moisture was removed before deposition of the impregnant.

EXAMPLE 3

This example demonstrates impregnation of a red phosphorus-silica nanocomposite aerogel substrate sample with decomposition products of iron pentacarbonyl impregnant using the apparatus of FIG. 1.

A base catalyzed silica sol was prepared using tetramethoxysilane (TMOS), 100% anhydrous methyl alcohol, 30% in water ammonium hydroxide and 18 MΩ-cm water. Two mixtures were prepared: mixture A consisted of 2.857 g methyl alcohol and 1.864 g TMOS, and mixture B consisted of 2.853 g methyl alcohol, 0.111 g ammonium hydroxide and 0.762 g water. Mixture A was poured into mixture B with stirring and allowed to mix for 15 seconds. The resulting sol was pipetted into a mold containing red phosphorus powder and allowed to percolate through the powder bed. Once all of the powder was wetted, the mold was immediately covered with airtight plastic film. The silica sol gelled after approximately 1 minute, "gluing" the red phosphorus particles together. After aging for 30 minutes, the gel was removed from its mold and placed into an acetone bath, which was replace twice daily for 4 days before drying under supercritical $CO_2$. After the aerogel was dried, a pyrophoric coating was impregnated on its inner and outer surfaces using the same procedure as in Example 1, above. Deposition time was 300 minutes and the weight increased by about 5%. The weight before deposition was 0.158 g and after deposition was 0.166 g. Any adsorbed surface moisture was removed before deposition of the impregnant.

While presently preferred embodiments have been shown of the novel invention and of the several modifications discussed, persons skilled in this art will readily appreciate that various additional changes and modifications can be made without departing from the spirit of the invention as defined and differentiated by the following claims.

What is claimed:

1. An article comprising a combustible substrate and an impregnant on and in said substrate; said substrate is a porous, permeable, high surface area material selected from the group consisting of supercritically dried reaction product of formaldehyde and a polyhydroxybenzene, ambiently dried reaction product of formaldehyde and a polyhydroxybenzene, supercritically dried reaction product of formaldehyde and a polyhydroxybenzene pyrolyzed to carbon, ambiently dried reaction product of formaldehyde and a polyhydroxybenzene pyrolyzed to carbon, and red phosphorus/silica aerogel; said impregnant is a substance that reacts and produces heat on exposure to oxygen ($O_2$) selected from the group consisting of elemental metals and alloys thereof; amount of said impregnant on and in said substrate is sufficient to provide enough energy on exposure to oxygen to cause said substrate to ignite and burn for more than about one half of a minute and thereby emit infrared radiation.

2. The article of claim 1 which is self-igniting upon exposure to oxygen, wherein said substrate exhibits continuous porosity and ultrafine cell size less than about 0.5 micron and its density is less than about 0.3 g/cm$^3$; wherein the polyhydroxybenzene is resorcinol; and wherein said impregnant is iron metal that is a thermal decomposition product of iron pentacarbonyl.

3. The article of claim 1 wherein the polyhydroxybenzene is selected from the group consisting of resorcinol, phloroglucinol, hydroquinone, and mixtures thereof, and said impregnant is selected from the group consisting of iron which is a thermal decomposition product of iron pentacarbonyl, ferrocene or iron acetylacetonate; nickel which is a thermal decomposition product of nickel pentacarbonyl or nickel acetylacetonate; aluminum; magnesium; calcium; lithium; sodium; potassium; phosphorous; zirconium; titanium; and alloys and mixtures thereof.

4. The article of claim 2 wherein the amount of said impregnant is at least about 20% of the weight of said substrate; and said article, on contact with oxygen, burns for a period of time of 5–7 minutes, based on a 0.5-cm$^3$ article.

5. The article of claim 2 wherein the amount of said impregnant is at least about 5% of the weight of said substrate; and said article, on contact with oxygen, burns for a period of about 2 minutes to about one quarter of one hour, based on a 0.5-cm$^3$ article.

6. A process for preparing an article composed of a substrate and an impregnant; the substrate is selected from the group consisting of a supercritically dried reaction product of formaldehyde and a polyhydroxybenzene, ambiently dried reaction product of formaldehyde and a polyhydroxybenzene, supercritically dried reaction product of formaldehyde and a polyhydroxybenzene pyrolyzed to carbon, ambiently dried reaction product of formaldehyde and a polyhydroxybenzene pyrolyzed to carbon, and red phosphorus/silica aerogel; said process comprising the step of depositing on and in the substrate a sufficient amount of the impregnant to provide enough energy, on exposure to oxygen, to cause the substrate to ignite and burn for a period of time exceeding about ½ of one minute, thereby emitting infrared radiation, and when the impregnant is selected from the group consisting of elemental metals and alloys thereof.

7. The process of claim 6 wherein the substrate is a reaction product of formaldehyde and a polyhydroxybenzene reacted in presence of a basic catalyst followed by supercritical drying.

8. The process of claim 6 wherein the impregnant is deposited on and in the substrate by flowing an essentially inert gas saturated with the impregnant precursor through a conduit containing the substrate whereby the impregnant precursor is thermally decomposed and deposited on and in the substrate.

9. The process of claim 8 wherein the flowing gas contains' under 10% by volume, of a reducing gas.

10. The process of claim 8 wherein the polyhydroxybenzene is selected from the group consisting of resorcinol, phloroglucinol, hydroquinone, and mixtures thereof, and the impregnant is selected from the group consisting of iron which is a thermal decomposition product of iron pentacarbonyl or ferrocene or iron acetylacetonate; nickel which is a thermal decomposition product of nickel pentacarbonyl or nickel acetylacetonate; aluminum; magnesium; calcium; lithium; sodium; potassium; phosphorous; zirconium; titanium; and alloys and mixtures thereof.

11. The process of claim 8 wherein the substrate has continuous porosity and ultrafine cell size less than about 0.5 micron and its density is less than about 0.3 g/cm$^3$; wherein the polyhydroxybenzene is resorcinol; and wherein the impregnant is iron metal formed by thermal decomposition of iron pentacarbonyl.

12. The process of claim 10 wherein amount of the impregnant is at least about 5% of the weight of said substrate; and the article, on contact with oxygen, burns for a period of time ranging from about 2 minutes to about ¼ of one hour, based on a 0.5-cm$^3$ article.

13. The process of claim 10 wherein amount of the impregnant is at least about 20%, based on the weight of said substrate; and the article, on contact with oxygen, burns for a period of time of 5–7 minutes, based on a 0.5-cm$^3$ article.

14. The process of claim 12 including the step of removing water and other volatile matter that may be on or in the substrate before depositing the impregnant.

* * * * *